United States Patent [19]

Silvander

[11] 4,413,927

[45] Nov. 8, 1983

[54] ELEMENT FOR USE IN CONCRETE PILE CASTING TO ALIGN COUPLING MEMBERS ON END FITTINGS

[76] Inventor: Frank O. Silvander, Richertsgatan 12, S-412 60 Göteborg, Sweden

[21] Appl. No.: 380,241

[22] Filed: May 20, 1982

[51] Int. Cl.[3] ..... E02D 5/30; E02D 5/34

[52] U.S. Cl. ..... 405/252; 52/223 R; 249/178; 405/231; 405/251

[58] Field of Search ..... 405/251, 252, 231, 239, 405/256, 257; 249/85, 92, 90, 96, 158, 165, 178; 52/127, 223

[56] References Cited

U.S. PATENT DOCUMENTS

| | | | |
|---|---|---|---|
| 3,248,888 | 5/1966 | Williams | 405/252 X |
| 3,504,500 | 4/1970 | Fristedt | 405/252 |
| 3,603,557 | 9/1971 | Lind | 249/165 X |
| 3,901,042 | 8/1975 | Wahman | 405/252 |
| 3,953,981 | 5/1976 | Axelsson et al. | 405/251 |
| 4,316,595 | 2/1982 | Wheeler et al. | 249/96 X |

*Primary Examiner*—Dennis L. Taylor

*Attorney, Agent, or Firm*—Harness, Dickey & Pierce

[57] ABSTRACT

An element for use in concrete pile casting to align coupling members on end fittings during the pile casting operation. The end fittings have key grooves, each such groove designed, when two concrete pile sections are to be joined together, to receive therein a locking key to interconnect the end fitting at one of the ends of a concrete pile section with a matching end fitting at the opposed end of the other pile section. At the bottom of each key groove is formed a through-passage with a recessed seat therein to accommodate the coupling member which rests freely in the seat and which is coupled to a reinforcement iron rod extending lengthwise through the concrete pile.

The aligning element comprises a presser means extending through a support member which is placed in one of the key grooves. The presser means is arranged to be pressed against the free end of the coupling member while the side faces of the key groove serve as back-up faces to said support member.

2 Claims, 3 Drawing Figures

ELEMENT FOR USE IN CONCRETE PILE CASTING TO ALIGN COUPLING MEMBERS ON END FITTINGS

BACKGROUND OF THE INVENTION

The subject invention concerns an element designed to align coupling members on end fittings during concrete pile casting. The end fittings used for this purpose have key grooves formed therein, each such groove being designed, when two concrete pile sections are to be joined together in end-to-end position, to receive a locking key therein to interconnect the end fitting at one of the ends of one concrete pile section with a matching end fitting arrangement at the opposed end of the other pile section. At the bottom of each key groove is arranged a through-passage with a recessed seat therein to accommodate the coupling member which rests freely in the seat and which is coupled to a reinforcement iron rod extending lengthwise through the concrete pile.

As a rule, concrete piles are manufactured in sections of suitable lengths and have a core made up of lengthwise reinforcement iron rods about which wires are wound to form a reinforcement cage. A coupling member is screwed onto each end of the reinforcement rods and extends through an end fitting provided at each end of the core.

It is already known to arrange the head of the coupling member freely supported in a seat in the end fitting. When interconnected concrete pile sections are driven in end-to-end position into the ground tensile stress that occurs between the blows will be efficiently taken by the reinforcement irons while at the same time the movability of the coupling member relative to the end fitting serves to avoid that the thrust during the driving-down operation damages the reinforcement rods, which may result in the entire pile section having to be rejected. Such damage and ensuing rejection is not uncommon when the coupling members are rigidly connected with the end fitting or when the reinforcement rods are welded directly onto the end fitting.

However, in some already cast concrete piles it has been found that one or several of the coupling members do not always assume a correct position in their respective seats, aligned with and in abutment against the associated end fittings. As a result, it may not be possible to insert the locking keys into the associated key grooves to join together two pile sections. Furthermore, even when the locking keys can be inserted into their associated grooves the axial play is often too small between the free end of the coupling member and the locking key positioned externally thereof. The result is that the intended effect is lost, that is, the ability of the coupling member to move axially when exposed to the effects of impacts from the driving-down apparatus.

One reason for the occurrence of the problem outlined above is the time lag between the arrangement of the reinforcement cage in alignment with the end fittings in the casting mold and the casting operation proper. It has been found that the axial play between the coupling member and the blocking key should be at least 3 millimeters. In concrete casting vibrator means are used to ensure that the concrete fills out the casting mold entirely. Also the vibrations may contribute to the occurrence of insufficient axial play.

SUMMARY OF THE INVENTION

The subject invention relates to an element by means of which alignment may be maintained during the entire casting operation while at the same time it ensures the desired amount of axial play.

The inventive object is characterised in that the aligning element comprises a presser means extending through a support member placed in one of the key grooves formed in the end fitting, said support member being arranged to be pressed against the free end of the coupling member while the side faces of said key groove serve as back-up faces to said support member.

BRIEF DESCRIPTION OF THE DRAWINGS

The invention will be described in closer detail in the following with reference to one embodiment thereof illustrated in the accompanying drawings, wherein.

DETAILED DESCRIPTION OF A PREFERRED EMBODIMENT

Figure 1:
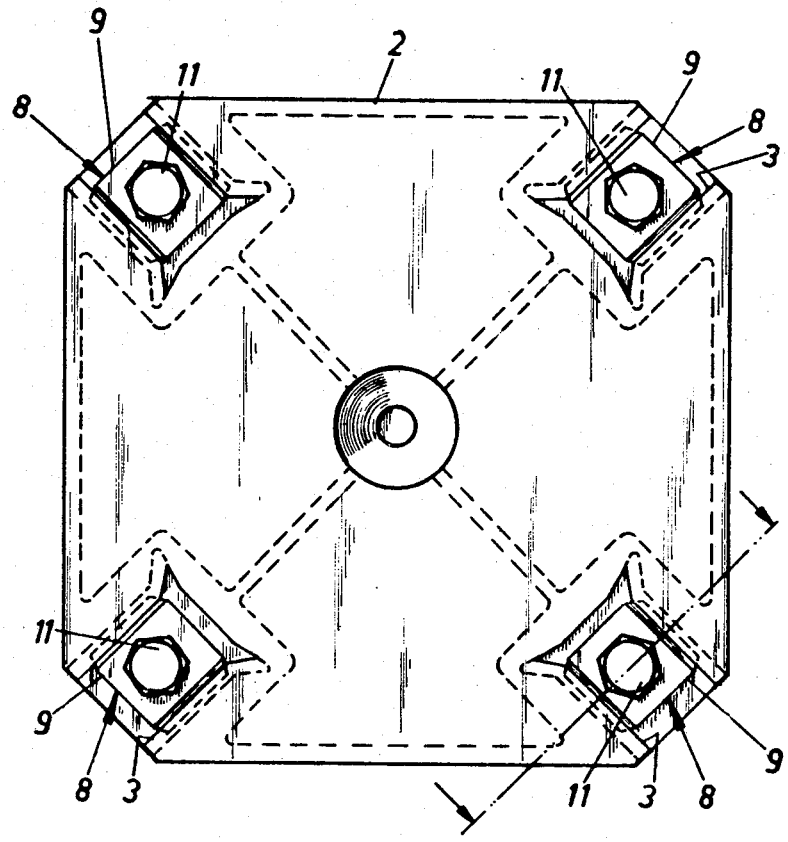
FIG. 1 is an end view of a concrete pile section provided with end fittings and means in accordance with the invention.
Figure 2:
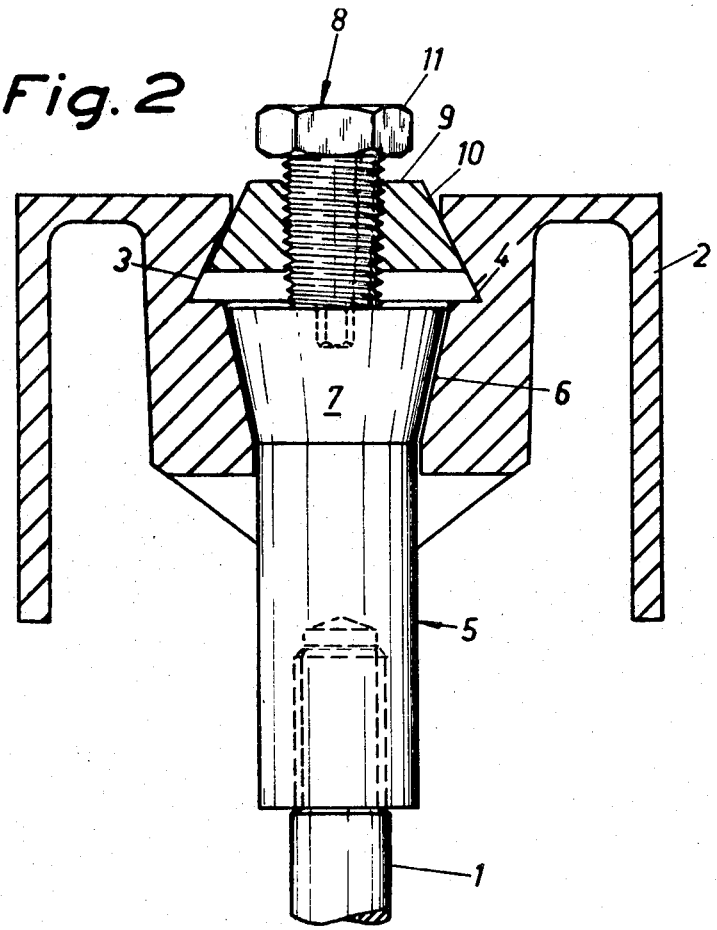
FIG. 2 is a section along line II—II in FIG. 1 as seen on an enlarged scale.
Figure 3:
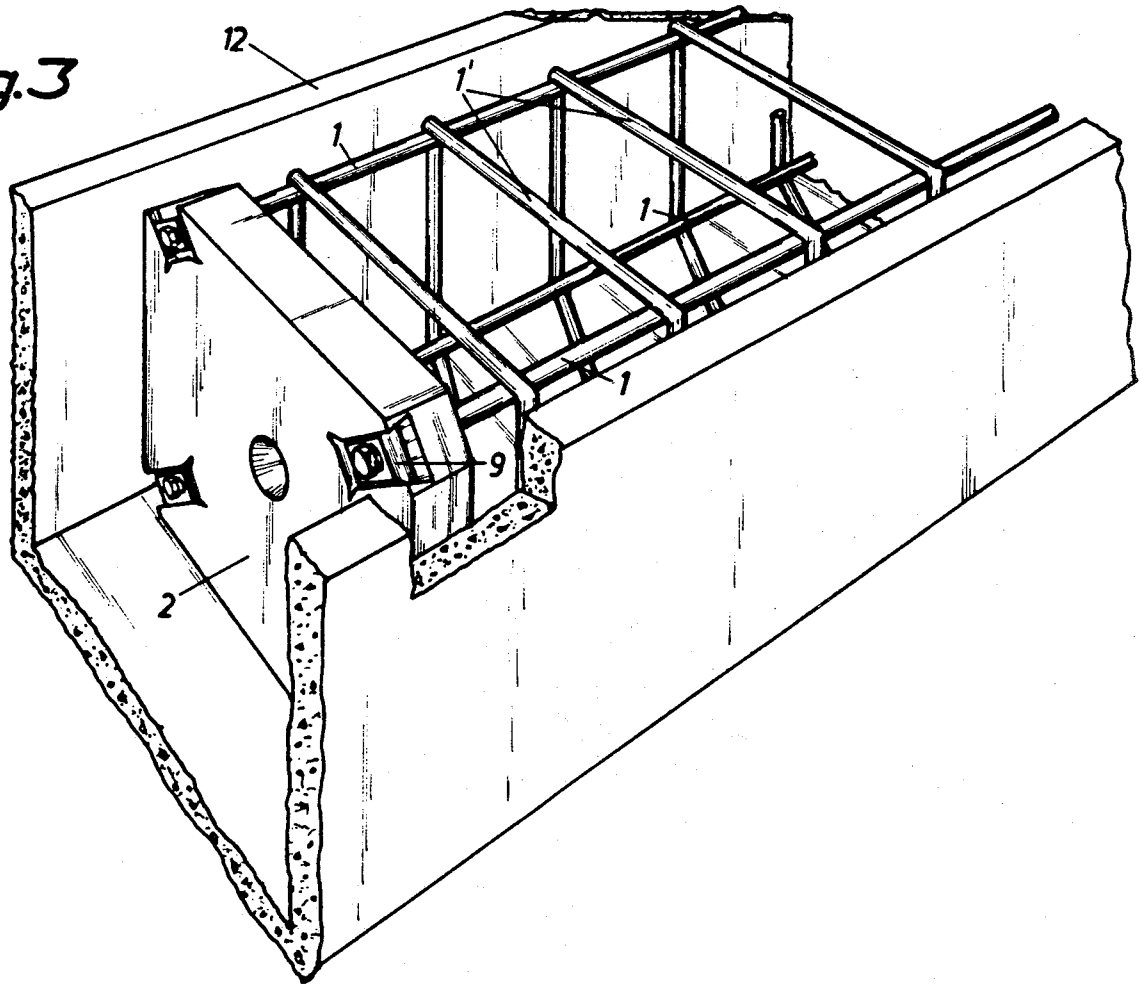
FIG. 3 is a perspective view of a casting mold showing the end piece and a reinforcement cage when prepared for casting.

The concrete pile sections to be produced are cast in a casting mold with a reinforcement cage 1' in the form of quadrilateral elements having a square cross-sectional shape. The reinforcement cage 1' comprises lengthwise reinforcement rods 1, one at each corner area. End fittings 2, one at each end of the mold, are provided at each one of their corners with a key groove 3 which extends in a direction towards the center of the end fitting and which converges upwards. In the bottom 4 of the key groove is formed a through-passage through which extends a coupling member 5. The through-passage converges in the direction away from the key groove 3 and forms a seat 6 in which is received the head 7 of a coupling member 5. The latter is screwed onto a reinforcement iron 1 and rests in the through-passage in a somewhat recessed position below the level of the bottom 4 of the key groove 3.

An aligning element 8 is mounted in each key groove 3, said aligning element consisting of a support 9 having abutment faces 10 thereon abutting against the lateral walls of the key groove 3, and of a tightening screw 11 which is screwed through the support 9 into abutment against the free end of the coupling member 5.

When the reinforcement cage 1' is to be aligned relative to the end fittings 2 on either side of the mold 12, the coupling members 5 on the reinforcement rods 1 are screwed on until they assume a position, wherein the distance between the free ends of the coupling members on each reinforcement iron is the same at all four reinforcement rods. The end fittings 2 are then moved outwards until the heads 7 of the coupling sleeves 5 rest in the seats 6 in the end fittings 2. An aligning element 8 is inserted into each one of the key grooves 3, as illustrated in FIG. 1, and the tightening screw 11 is screwed into engagement with the free end of the coupling member 5. The end fitting 2 is thereafter checked for correct angular position relative to the casting mold 12. Minor angular deviations are corrected by loosening one or several of the tightening screws. Since the coupling members 5 are spaced considerably distances apart in the end fitting 2 small corrective alterations of the tightening force will result in a comparatively large change of the angular position of the end fitting. When the alignment is completed the casting operation may be performed, including the required vibration step, without risk of relative movements between the end fitting 2 and the coupling members 5.

When the casting is completed and the concrete has set, the concrete pile section may be lifted out of the mold 12 and the aligning elements 8 be removed from the key grooves 3. The aligning elements may then be used when the next concrete pile section is cast.

The invention is not limited to the embodiment as illustrated and described above but several modifications are possible within the scope of the appended claims. Other types of tightening means than tightening screw 11 may of course be used. Also the supports 9 may have a different design or shape, allowing them to be mounted on and dismounted from the end fittings also when the latter rest inside the casting mold.

I claim:

1. An element for use in concrete pile casting to align coupling members on end fittings during the pile casting operation, comprising key grooves formed in said end fittings, locking keys designed, when two concrete pile sections are to be joined together in end-to-end position, to engage in said key grooves to interconnect the end fitting at one of the ends of one of said concrete pile sections with a matching end fitting arranged at the opposed end of the other one of said two concrete pile sections, a through-passage at the bottom of each one of said key grooves, a recessed seat in said through-passage, said seat arranged to accommodate therein one of said coupling members, said coupling member resting freely in said seat, one such coupling member being coupled to each one of the reinforcement iron rods extending lengthwise through said concrete pile sections, the improvement comprising a presser means, a support member placed in one of said key grooves formed in said end fittings, said presser means extending through said support member, said support member arranged to be pressed against the free end of said coupling member while the side faces of the associated one of said key grooves serve as back-up faces to said support member.

2. A device as claimed in claim 1, wherein said presser means is a tightening screw.

* * * * *